US012422217B2

(12) United States Patent
Lee et al.

(10) Patent No.: US 12,422,217 B2
(45) Date of Patent: Sep. 23, 2025

(54) FIREARM HOLSTER WITH SAFETY FEATURES

(71) Applicant: Strike IP, LLC, Las Vegas, NV (US)

(72) Inventors: Shanyao Lee, Las Vegas, NV (US); Chien-Yuan Cheng, Las Vegas, NV (US)

(73) Assignee: Strike IP, LLC, Las Vegas, NV (US)

( * ) Notice: Subject to any disclaimer, the term of this patent is extended or adjusted under 35 U.S.C. 154(b) by 132 days.

(21) Appl. No.: 18/531,663

(22) Filed: Dec. 6, 2023

(65) Prior Publication Data

US 2025/0189267 A1 Jun. 12, 2025

(51) Int. Cl.
*F41C 33/02* (2006.01)

(52) U.S. Cl.
CPC ..... *F41C 33/0236* (2013.01); *F41C 33/0281* (2013.01)

(58) Field of Classification Search
CPC ..... F41C 33/0236; F41C 33/0281; F41C 33/0263
USPC ..... 224/243, 244, 238, 192, 193, 198
See application file for complete search history.

(56) References Cited

U.S. PATENT DOCUMENTS 3,763,587 A * 10/1973 Firmalino ..... F42C 3/00 42/106
4,043,065 A * 8/1977 Musgrave ..... F41A 19/34 42/106
4,055,015 A * 10/1977 Musgrave ..... F41C 33/04 42/106
4,138,044 A * 2/1979 Musgrave ..... F41C 33/0281 D3/222
4,298,150 A * 11/1981 Seldeen ..... F41C 33/0281 224/912
7,950,553 B2 * 5/2011 Rassias ..... F41C 33/0281 224/912
8,312,803 B2 * 11/2012 Oz ..... F41A 19/34 89/1.4
9,194,636 B2 * 11/2015 McAninch ..... F41A 19/52
9,500,439 B1 * 11/2016 Dietrich ..... F41A 3/72
10,281,225 B2 * 5/2019 Shamrai ..... F41A 21/488
11,098,978 B2 * 8/2021 Rassias ..... F41C 33/0245
11,619,464 B2 * 4/2023 Cerda ..... B60R 7/14 248/205.3
11,740,048 B2 * 8/2023 Featherston, Jr. ..... F41A 23/18 42/94
2003/0042279 A1 * 3/2003 Locklear, III ..... F41C 33/0209 224/244
2007/0163164 A1 * 7/2007 Avrahami ..... F41C 33/04 42/87
2008/0179360 A1 * 7/2008 Lowe ..... F41C 33/0209 224/246

(Continued)

*Primary Examiner* — Nathan J Newhouse
*Assistant Examiner* — Lester L Vanterpool
(74) *Attorney, Agent, or Firm* — Andy M. Han; Han IP PLLC

(57) ABSTRACT

A device implementable on a firearm includes a holster including a case with a void therein. The void is configured to accommodate the firearm such that the firearm is at least partially received in the void responsive to the firearm being holstered in the void. The case further includes at least one physical feature configured to engage with at least one portion of the firearm as the firearm is inserted into the void to be holstered such that the firearm is rendered inoperable while being holstered.

4 Claims, 7 Drawing Sheets

(56) References Cited

U.S. PATENT DOCUMENTS

| | | | | |
|---|---|---|---|---|
| 2013/0306691 | A1* | 11/2013 | Baumann | F41C 33/0263 224/244 |
| 2014/0338522 | A1* | 11/2014 | Bellione | F41A 15/16 42/1.06 |
| 2015/0184959 | A1* | 7/2015 | Parnell | F41A 3/72 89/1.4 |
| 2015/0369561 | A1* | 12/2015 | Zdarsky | F41C 33/0263 224/243 |
| 2017/0191795 | A1* | 7/2017 | Xia | F41C 33/0263 |

* cited by examiner

FIREARM HOLSTER WITH SAFETY FEATURES

TECHNICAL FIELD

The present disclosure is generally related to firearm accessories and, more particularly, to a firearm holster with safety features.

BACKGROUND

Unless otherwise indicated herein, approaches described in this section are not prior art to the claims listed below and are not admitted as prior art by inclusion in this section.

Firearm holsters, or holsters, are devices designed for carrying a firearm on the person of a user (e.g., on the hip, waist or chest), in a vehicle or on another type of transportation. A holster is typically a case made of leather, fabric or a thermoplastic material (e.g., Kydex) and shaped to accommodate a firearm (e.g., pistol) such that the firearm can be held securely by and within the holster. Typically, holsters are designed to shield the trigger portion of the firearm to prevent accidental discharge by the user (e.g., when the user intends to pull the firearm out of the holster). However, due to various reasons (e.g., due to unintentional action by the user, due to the material of the holster being worn, due to snagging by the holster or clothing of the user, or due to firearm mechanism failure), accidental discharge of a holstered firearm could still occur. Therefore, there is a need for a solution of a firearm holster with safety features to address such an issue.

SUMMARY

The following summary is illustrative only and is not intended to be limiting in any way. That is, the following summary is provided to introduce concepts, highlights, benefits and advantages of the novel and non-obvious techniques described herein. Select implementations are further described below in the detailed description. Thus, the following summary is not intended to identify essential features of the claimed subject matter, nor is it intended for use in determining the scope of the claimed subject matter.

In view of the aforementioned issue, an objective of the present disclosure is to provide an innovative design of a firearm holster with safety features. It is believed that a foldable sight under various proposed schemes of the present disclosure may address or otherwise alleviate the aforementioned issue(s). For instance, a holster under the various proposed schemes is believed to provide extra safety to the firearm user (and anyone in the vicinity) when the firearm is holstered in the holster. When the firearm is withdrawn from the holster, the extra safety may be disengaged automatically.

In one aspect, a device implementable on a firearm may include a holster including a case with a void therein. The void may be configured to accommodate the firearm such that the firearm is at least partially received in the void responsive to the firearm being holstered in the void. The case may further include at least one physical feature configured to engage with at least one portion of the firearm as the firearm is inserted into the void to be holstered such that the firearm is rendered inoperable while being holstered.

BRIEF DESCRIPTION OF THE DRAWINGS

The accompanying drawings are included to provide a further understanding of the disclosure and are incorporated in and constitute a part of the present disclosure. The drawings illustrate implementations of the disclosure and, together with the description, explain the principles of the disclosure. It is appreciable that the drawings are not necessarily in scale as some components may be shown to be out of proportion than the size in actual implementation to clearly illustrate the concept of the present disclosure.

DETAILED DESCRIPTION OF PREFERRED IMPLEMENTATIONS

Figure 1:
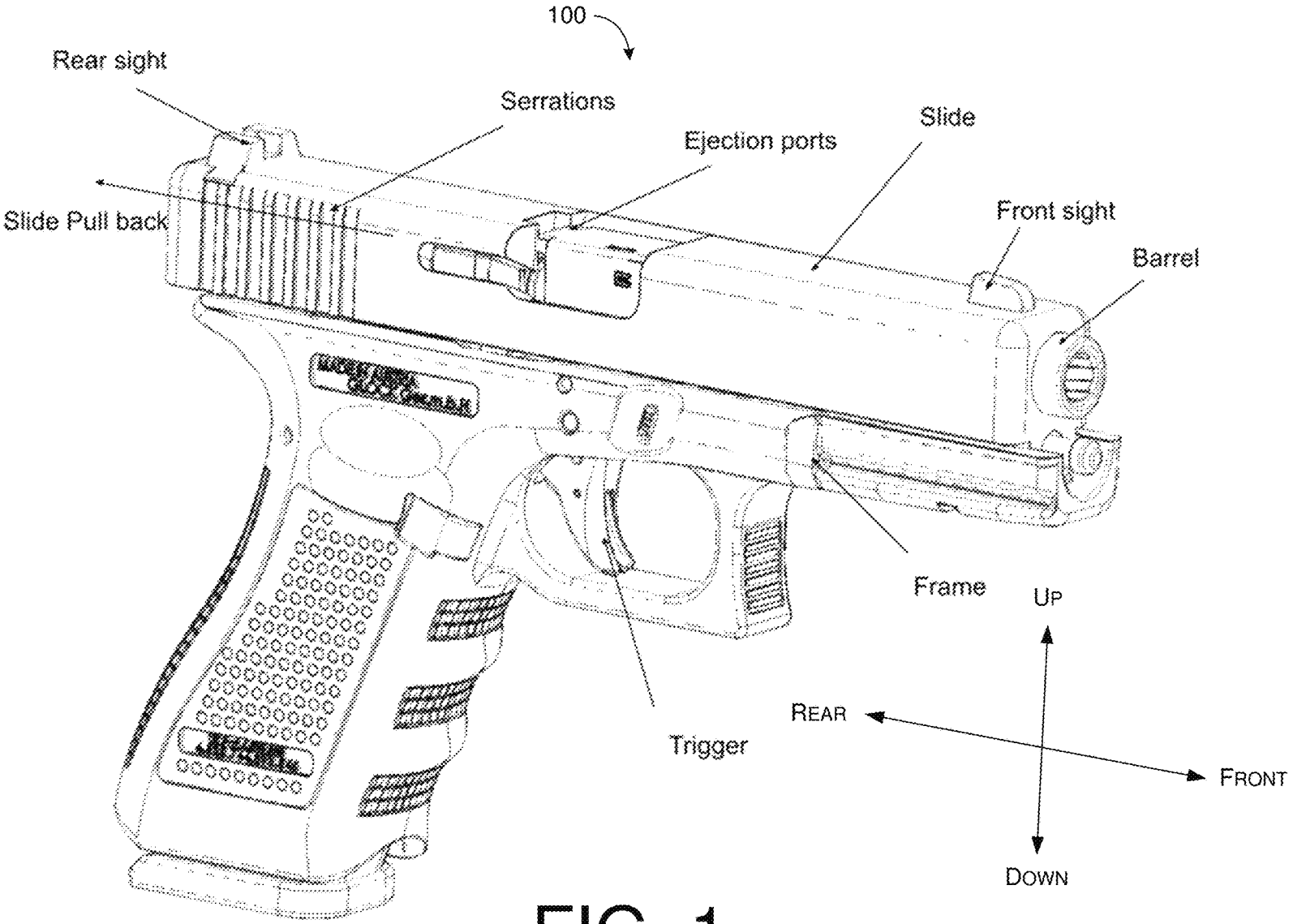
FIG. 1 is a diagram of an example firearm on or with which various proposed schemes in accordance with the present disclosure may be implemented.

Detailed embodiments and implementations of the claimed subject matters are disclosed herein. However, it shall be understood that the disclosed embodiments and implementations are merely illustrative of the claimed subject matters which may be embodied in various forms. The present disclosure may, however, be embodied in many different forms and should not be construed as limited to the exemplary embodiments and implementations set forth herein. Rather, these exemplary embodiments and implementations are provided so that description of the present disclosure is thorough and complete and will fully convey the scope of the present disclosure to those skilled in the art. In the description below, details of well-known features and techniques may be omitted to avoid unnecessarily obscuring the presented embodiments and implementations.

The position terms used in the present disclosure, such as "front", "forward", "rear", "back", "top", "bottom", "left", "right", "head", "tail" or the like assume a firearm in the normal firing position, with the firearm being in a position in which the longitudinal axis of the barrel of the firearm runs generally horizontally and the direction of firing points "forward" away from the operator or user of the firearm. The same convention applies for the direction statements used herein.

As used herein, the terms "proximal" and "proximally" may denote "forward" and "forwardly" with respect to the firearm, and the terms "distal" and "distally" may denote "rearward" and "rearwardly" with respect to the firearm. As used herein, the verb "to comprise" in this description, claims, and other conjugations are used in its non-limiting sense to mean those items following the word are included, but items not specifically mentioned are not excluded. As used herein, the word "forward" means moving in the direction that the projectile moves during firing a firearm. As used herein, the word "proximal" means closer to the reference point, in this case, the shooter. As used herein, the word "distal" means farther to the reference point, in this case, the shooter. Reference to an element by the indefinite article "a" or "an" does not exclude the possibility that more than one of the elements are present, unless the context clearly requires that there is one and only one of the elements. The indefinite article "a" or "an" thus usually means "at least one." Additionally, the words "a" and "an" when used in the present document in concert with the words "comprising" or "containing" denote "one or more.

All numeric values are herein assumed to be modified by the term "about," whether or not explicitly indicated. The term "about" generally refers to a range of numbers that one of skill in the art would consider equivalent to the recited value (i.e., having the same function or result). In many instances, the terms "about" may include numbers that are rounded to the nearest significant figure. The recitation of numerical ranges by endpoints includes all numbers within that range (e.g. 1 to 5 includes 1, 1.5, 2, 2.75, 3, 3.80, 4, and 5). All dimensions given herein are by way of examples to better illustrate the present disclosure embodiments and shall not be construed to limit the dimensions of the present disclosure embodiments to the given numeric values.

Overview

The following description is provided with reference to FIG. 1~FIG. 7 regarding a firearm holster with safety features under various proposed schemes in accordance with the present disclosure for a firearm. In some implementations, the firearm may be a pistol, such as a semiautomatic pistol or an automatic pistol.

FIG. 1 illustrates an example firearm 100 on or with which various proposed schemes in accordance with the present disclosure may be implemented. FIG. 2~FIG. 7 illustrate examples of implementation of various proposed schemes that may be implemented on example firearm 100. The following description of various proposed schemes is provided with reference to FIG. 1~FIG. 7. It is noteworthy that, while the various proposed schemes may be individually or separately described below, in actual implementations some or all of the proposed schemes may be utilized or otherwise implemented jointly. Of course, each of the proposed schemes may be utilized or otherwise implemented individually or separately.

Referring to FIG. 1, example firearm 100 may include certain components some of which are shown in FIG. 1 while some are not (e.g., due to being obscured by other component(s)). Those components shown in FIG. 1 include a frame, a trigger and a slide assembly slidably riding on the frame. The components of the slide assembly shown in FIG. 1 include a barrel, a slide, a front sight (e.g., front iron sight) on the slide and a rear sight (e.g., rear iron sight) installed on the slide. Moreover, the slide itself may have an ejection port (through which spent casing may be ejected upon firing of firearm 100) and serrations. As one of ordinary skill in the art would understand, with the barrel, the slide, or the slide assembly as a whole, pushed or otherwise pulled back to move rearward with respect to firearm 100, firearm 100 would be rendered inoperable (e.g., cannot be fired). That is, when the barrel, the slide, or the slide assembly as a whole, pushed or otherwise pulled back to move rearward with respect to firearm 100, firearm 100 may not be fired even if a firing pin thereof (not shown) had previously been pulled back and ready to fire.

As shown in each of FIG. 2~FIG. 6, a device under various proposed schemes in accordance with the present disclosure may include a holster 150. Holster 150 may include a case with a void therein. The void may be configured to accommodate firearm 100 such that firearm 100 is at least partially received in the void responsive to firearm 100 being holstered in the void. The case may further include at least one physical feature configured to engage with (e . . . , push against or pull on) at least one portion of firearm 100 as firearm 100 is inserted into the void to be holstered such that firearm 100 is rendered inoperable while being holstered. Moreover, the at least one physical feature may be further configured to disengage from (e.g., not push against or pull on) the at least one portion of firearm 100 as firearm 100 is withdrawn from the void to be unholstered such that firearm 100 is rendered operable upon being unholstered. That is, when firearm 100 is holstered in holster 150, one or more safety features of holster 150 may render firearm 100 inoperable (e.g., due to its barrel, slide and/or slide assembly being pushed/pulled rearward to disengage firearm 100), thereby making accidental discharge highly unlikely or impossible while firearm 100 is holstered properly in holster 150. Once firearm 100 is withdrawn out of holster 150, it would be back to being operable as the safety feature(s) of holster 150 is/are not engaged with firearm 100 anymore.

Under the various proposed schemes, in engaging with the at least one portion of firearm 100 as firearm 100 is inserted into the void to be holstered, the at least one physical feature may be configured to push or pull the at least one portion of firearm 100 as firearm 100 is inserted into the void to be holstered such that at least a slide or a barrel of firearm 100 is pushed or pulled rearward with respect to firearm 100 to render firearm 100 inoperable by disengaging firearm 100. When holstered in holster 150, the frame of firearm 100 would be secured by holster 150. Given that the frame is fixed by holster 150, under the proposed schemes, the barrel, the slide or the slide assembly may be pulled (or pushed) back by one or more physical features of holster 150, thereby rendering firearm 100 inoperable (e.g., cannot be fired) while firearm 100 is holstered.

Under various proposed schemes in accordance with the present disclosure, the case may be a one-piece case made of a synthetic material (e.g., thermoplastics such as Kydex) and shaped to accommodate firearm 100 such that firearm 100 may be held securely by and within holster 150 when firearm 100 is holstered therein. Alternatively, the case may be a multi-piece (e.g., two-piece) case made of leather or fabric and/or a synthetic material (e.g., thermoplastics such as Kydex) and shaped to accommodate firearm 100 such that firearm 100 may be held securely by and within holster 150 when firearm 100 is holstered therein. Under the various proposed schemes, In some implementations, the at least one physical feature may include a tab extending from a portion of the case.

Figure 2:
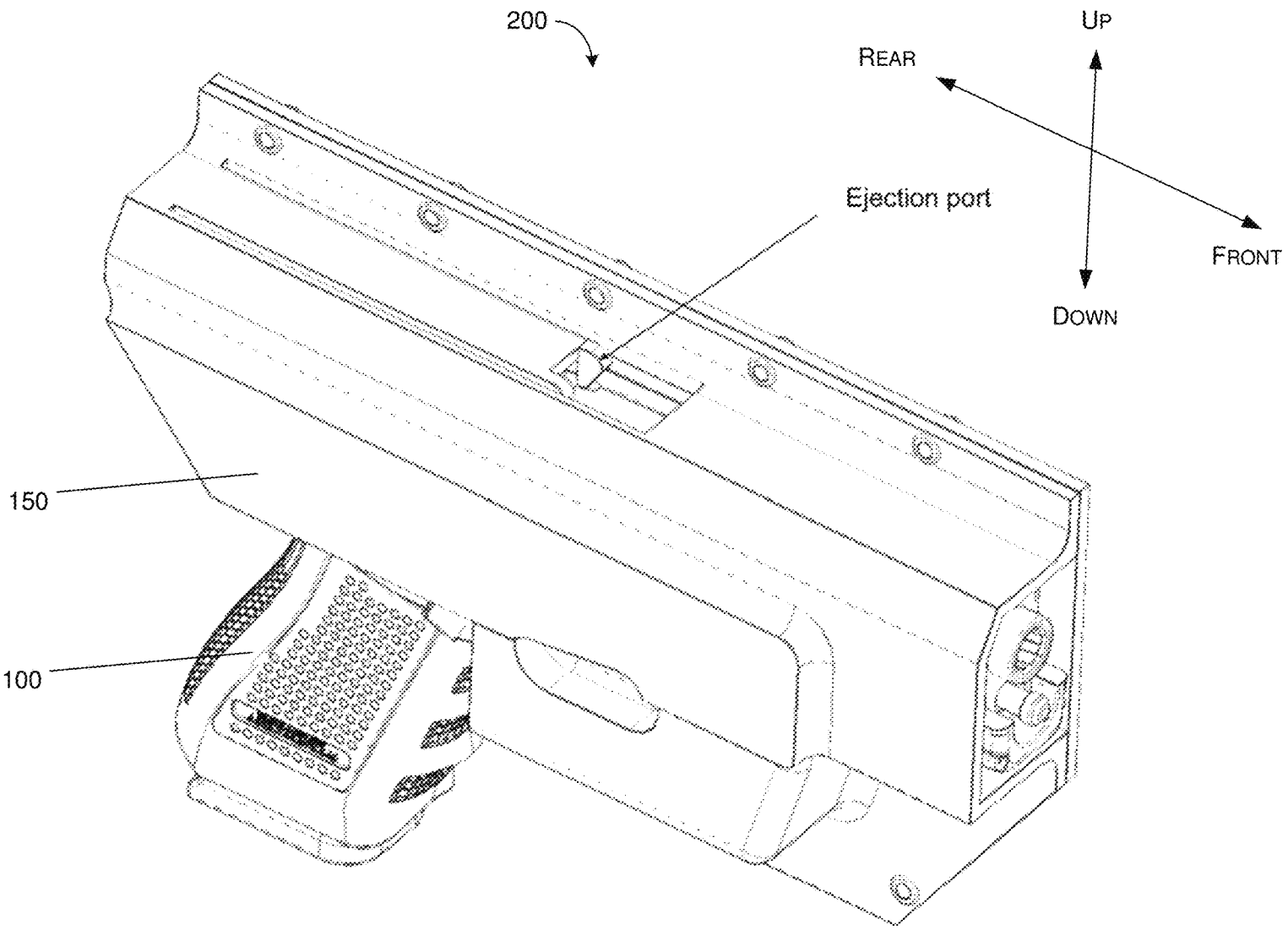
FIG. 2 is a diagram of an example implementation under a proposed scheme in accordance with the present disclosure.

FIG. 2 illustrates an example implementation 200 under a proposed scheme in accordance with the present disclosure. Referring to FIG. 2, a physical feature (e.g., tab) may be positioned on the case in a way and configured to engage with the ejection port of the slide of firearm 100 such that, as firearm 100 is inserted into the void to be holstered, the physical feature pushes or pulls back the ejection port to move the slide rearward with respect to firearm 100 to disengage firearm 100.

Figure 3:
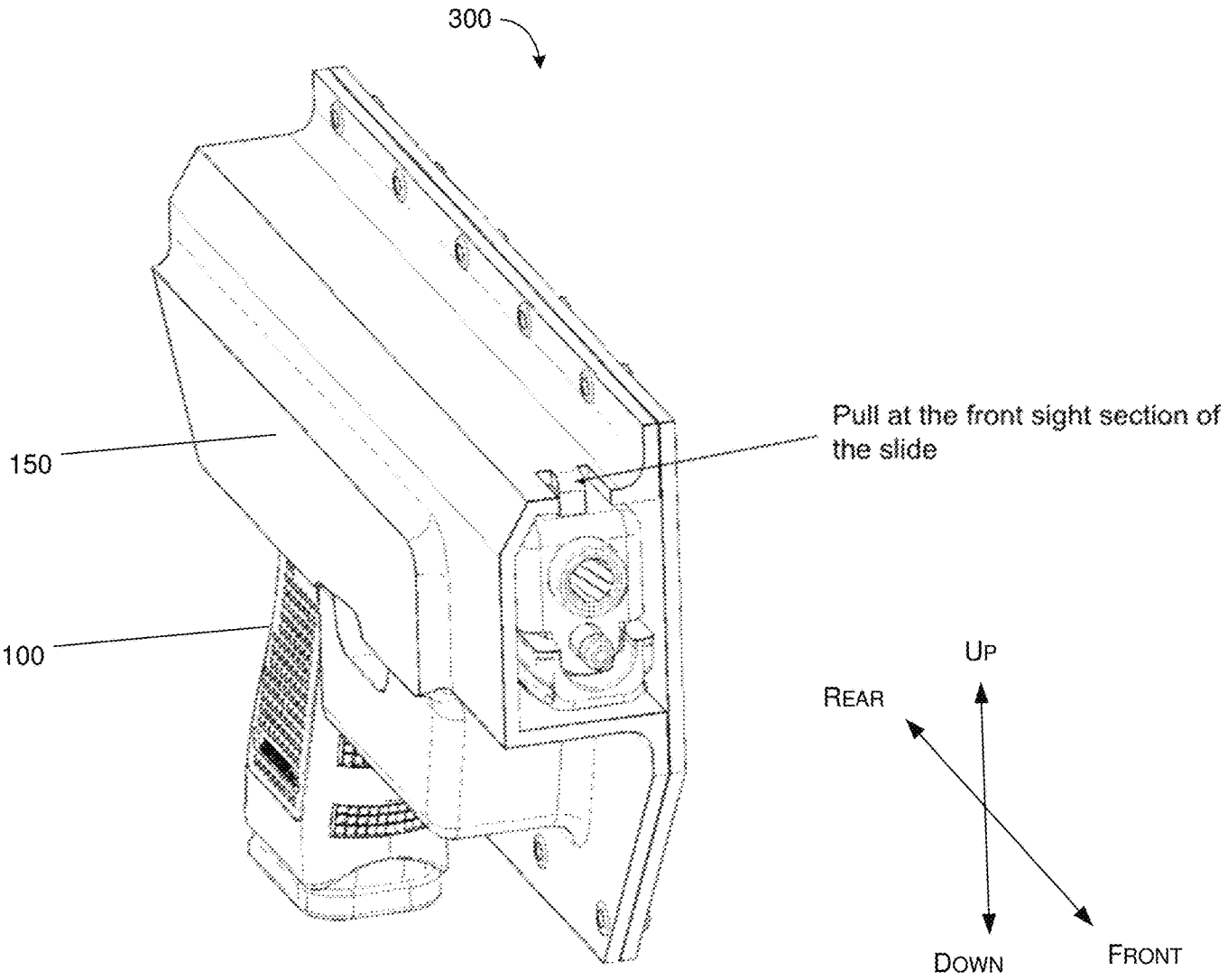
FIG. 3 is a diagram of an example implementation under a proposed scheme in accordance with the present disclosure.

FIG. 3 is a diagram of an example implementation 300 under a proposed scheme in accordance with the present disclosure. Referring to FIG. 3, a physical feature (e.g., tab) may be positioned on the case in a way and configured to engage with the front sight on the slide of firearm 100 such that, as firearm 100 is inserted into the void to be holstered, the physical feature pushes or pulls back the front sight to move the slide rearward with respect to firearm 100 to disengage firearm 100.

Figure 4:
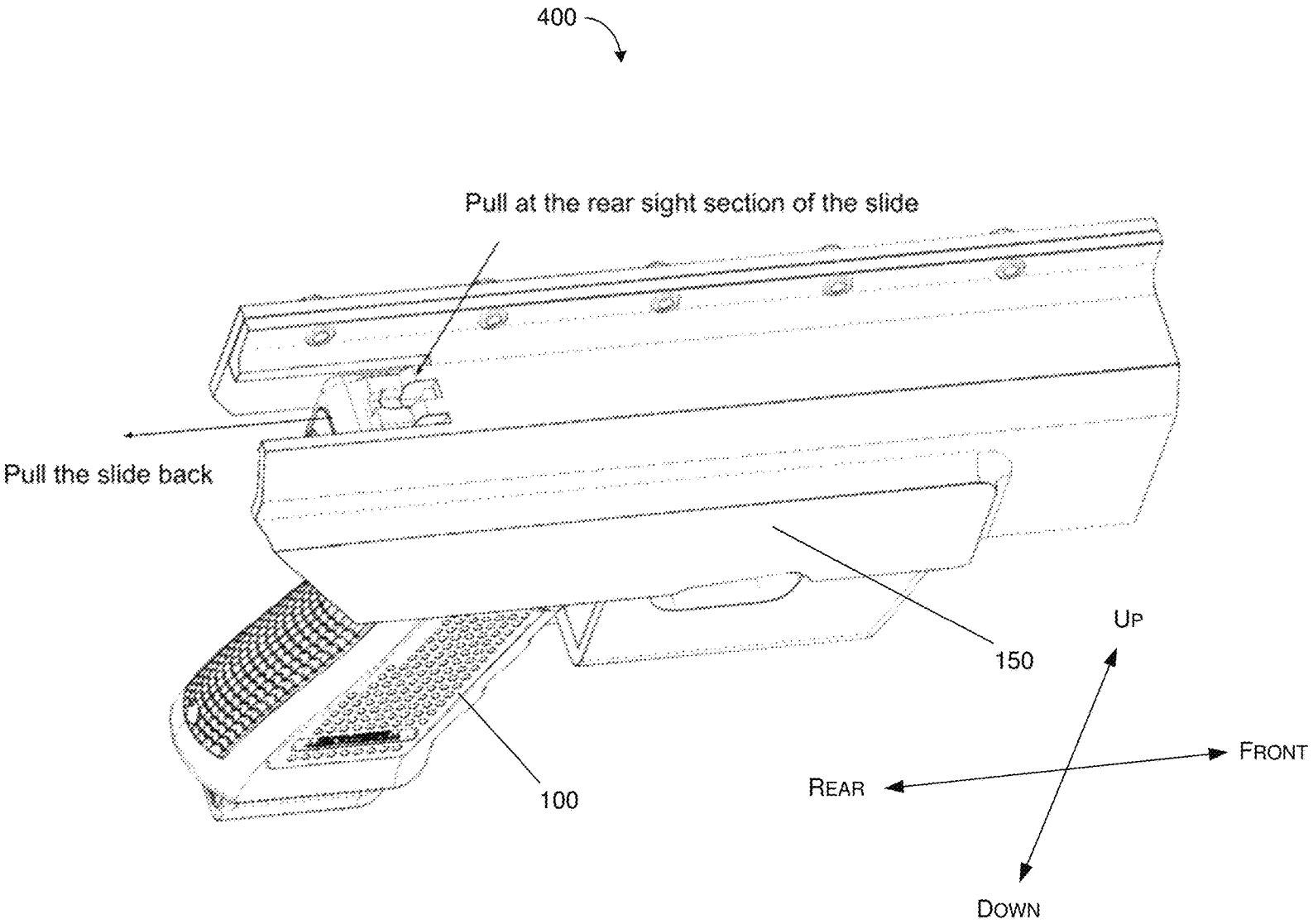
FIG. 4 is a diagram of an example implementation under a proposed scheme in accordance with the present disclosure.

FIG. 4 is a diagram of an example implementation 400 under a proposed scheme in accordance with the present disclosure. Referring to FIG. 4, a physical feature (e.g., tab) may be positioned on the case in a way and configured to engage with the rear sight on the slide of firearm 100 such that, as firearm 100 is inserted into the void to be holstered, the physical feature pushes or pulls back the rear sight to move the slide rearward with respect to firearm 100 to disengage firearm 100.

Figure 5:
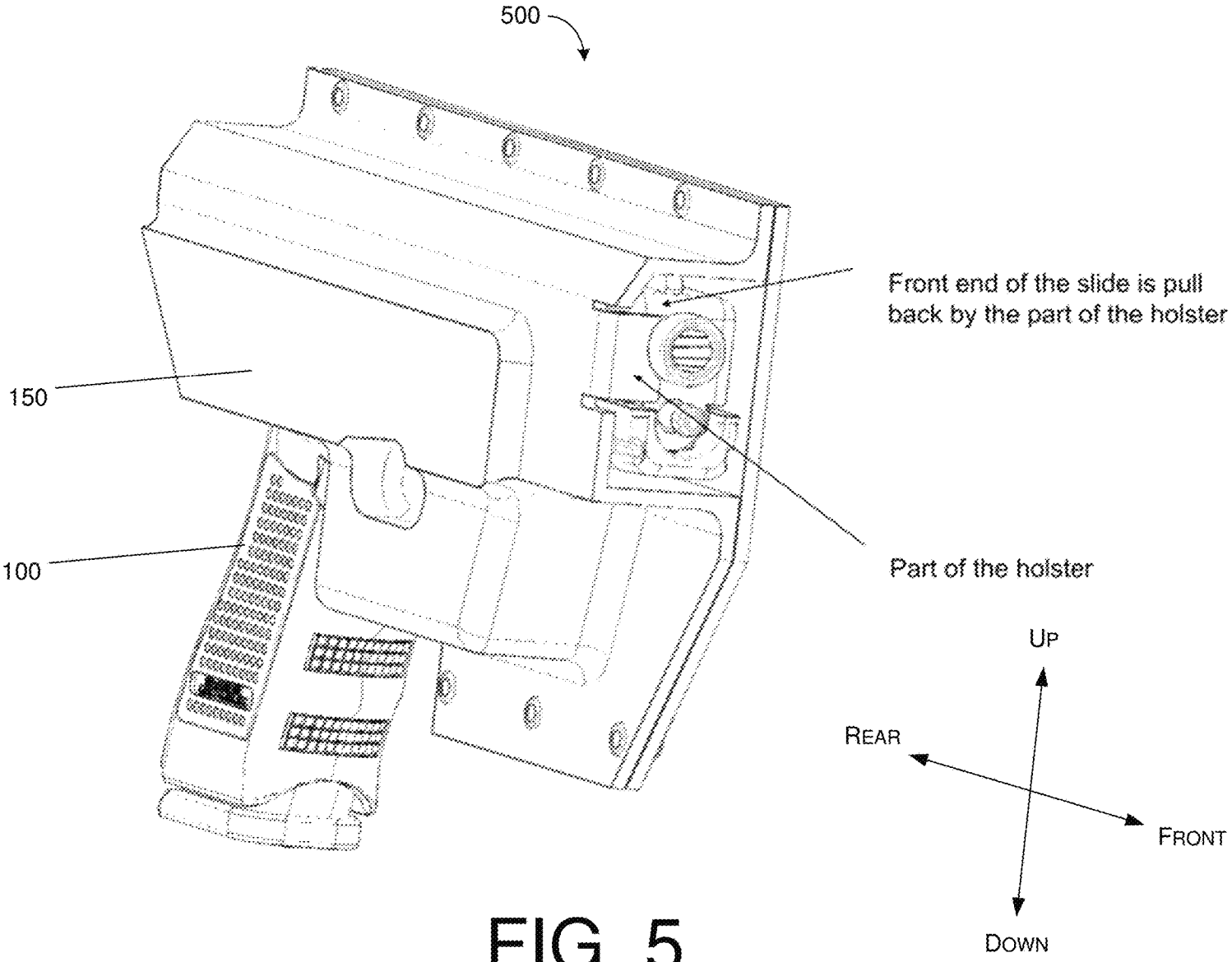
FIG. 5 is a diagram of an example implementation under a proposed scheme in accordance with the present disclosure.

FIG. 5 is a diagram of an example implementation 500 under a proposed scheme in accordance with the present disclosure. Referring to FIG. 5, a physical feature (e.g., tab) may be positioned on the case in a way and configured to engage with a front end of the slide of firearm 100 such that, as firearm 100 is inserted into the void to be holstered, the physical feature pushes or pulls back the front end to move the slide rearward with respect to firearm 100 to disengage firearm 100.

Figure 6:
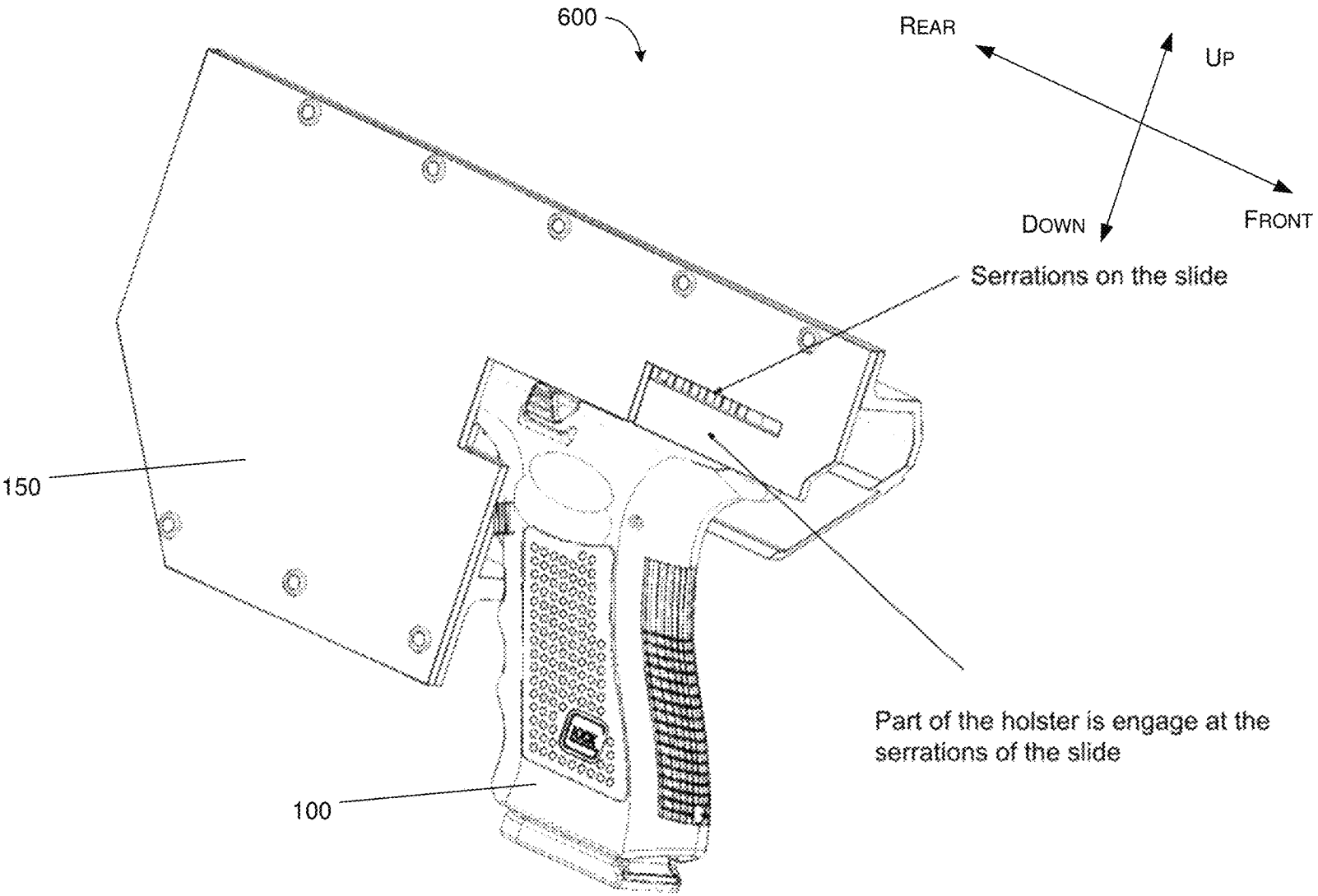
FIG. 6 is a diagram of an example implementation under a proposed scheme in accordance with the present disclosure.

FIG. 6 is a diagram of an example implementation 600 under a proposed scheme in accordance with the present disclosure. Referring to FIG. 6, a physical feature (e.g., tab) may be positioned on the case in a way and configured to engage with one or more serrations on the slide of firearm 100 such that, as firearm 100 is inserted into the void to be holstered, the physical feature pulls back the one or more serrations to move the slide rearward with respect to firearm 100 to disengage firearm 100.

Figure 7:
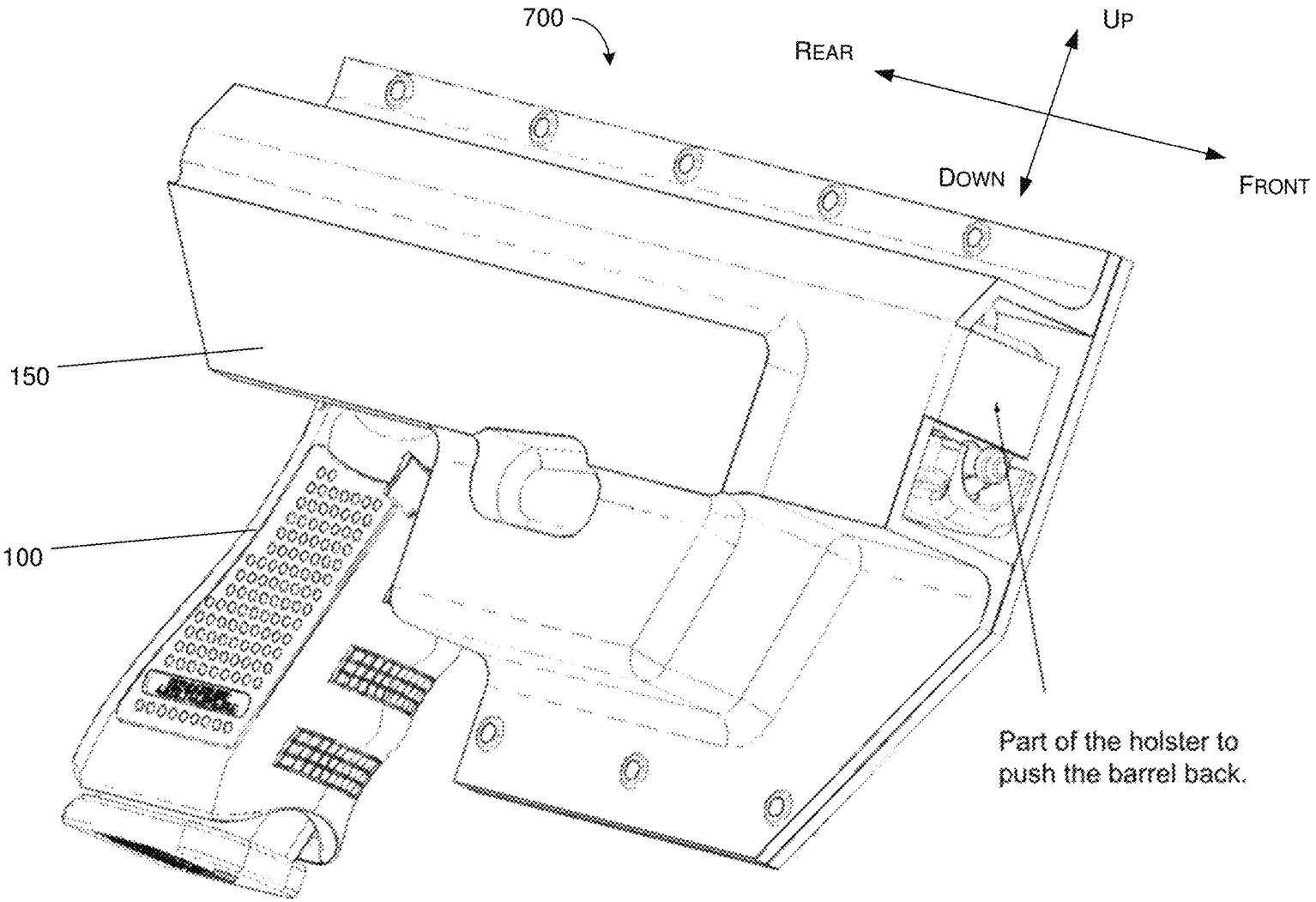
FIG. 7 is a diagram of an example implementation under a proposed scheme in accordance with the present disclosure.

FIG. 7 is a diagram of an example implementation 700 under a proposed scheme in accordance with the present disclosure. Referring to FIG. 7, a physical feature (e.g., tab) may be positioned on the case in a way and configured to engage with the barrel of firearm 100 such that, as firearm 100 is inserted into the void to be holstered, the physical feature pushes back the barrel to move the slide rearward with respect to firearm 100 to disengage firearm 100.

It is noteworthy that the portion of the firearm with which the at least one physical feature of holster 150 engages is not limited to the front sight, rear sight, ejection port, serration(s), front end of the slide and the barrel. That is, under other proposed schemes in accordance with the present disclosure, one or more different physical features of the case of holster 150 may engage with one or more portions of firearm 100 to provide extra safety in a similar way as described above.

Highlight of Select Features

In view of the above, select features of various implementations in accordance with the present disclosure are highlighted below.

In one aspect, a device implementable on a firearm may include a holster. The holster may include a case with a void therein. The void may be configured to accommodate the firearm such that the firearm is at least partially received in the void responsive to the firearm being holstered in the void. The case may further include at least one physical feature configured to engage with at least one portion of the firearm as the firearm is inserted into the void to be holstered such that the firearm is rendered inoperable while being holstered.

In some implementations, the at least one physical feature may be further configured to disengage from the at least one portion of the firearm as the firearm is withdrawn from the void to be unholstered such that the firearm is rendered operable upon being unholstered.

In some implementations, in engaging with the at least one portion of the firearm as the firearm is inserted into the void to be holstered, the at least one physical feature may be configured to push or pull the at least one portion of the firearm as the firearm is inserted into the void to be holstered such that at least a slide or a barrel of the firearm is pushed or pulled rearward with respect to the firearm to render the firearm inoperable by disengaging the firearm.

In some implementations, the at least one physical feature may include a tab extending from a portion of the case.

In some implementations, the tab may be configured to engage with an ejection port of the slide of the firearm such that, as the firearm is inserted into the void to be holstered, the tab pushes or pulls back the ejection port to move the slide rearward with respect to the firearm to disengage the firearm.

In some implementations, the tab may be configured to engage with a front sight on the slide of the firearm such that, as the firearm is inserted into the void to be holstered, the tab pushes or pulls back the front sight to move the slide rearward with respect to the firearm to disengage the firearm.

In some implementations, the tab may be configured to engage with a rear sight on the slide of the firearm such that, as the firearm is inserted into the void to be holstered, the tab pushes or pulls back the rear sight to move the slide rearward with respect to the firearm to disengage the firearm.

In some implementations, the tab may be configured to engage with a front end of the slide of the firearm such that, as the firearm is inserted into the void to be holstered, the tab pushes or pulls back the front end to move the slide rearward with respect to the firearm to disengage the firearm.

In some implementations, the tab may be configured to engage with one or more serrations on the slide of the firearm such that, as the firearm is inserted into the void to be holstered, the tab pulls back the one or more serrations to move the slide rearward with respect to the firearm to disengage the firearm.

In some implementations, the tab may be configured to engage with the barrel of the firearm such that, as the firearm is inserted into the void to be holstered, the tab pushes back the barrel to move the barrel and the slide rearward with respect to the firearm to disengage the firearm.

Additional Notes

The herein-described subject matter sometimes illustrates different components contained within, or connected with, different other components. It is to be understood that such depicted architectures are merely examples, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

Further, with respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

Moreover, it will be understood by those skilled in the art that, in general, terms used herein, and especially in the appended claims, e.g., bodies of the appended claims, are generally intended as "open" terms, e.g., the term "including" should be interpreted as "including but not limited to," the term "having" should be interpreted as "having at least," the term "includes" should be interpreted as "includes but is not limited to," etc. It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to implementations containing only one such recitation, even when the same claim includes the introductory phrases "one or more" or "at least one" and indefinite articles such as "a" or "an," e.g., "a" and/or "an" should be interpreted to mean "at least one" or "one or more;" the same holds true for the use of definite articles used to introduce claim recitations. In addition, even if a specific number of an introduced claim recitation is explicitly recited, those skilled in the art will recognize that such recitation should be interpreted to mean at least the recited number, e.g., the bare recitation of "two recitations," without other modifiers, means at least two recitations, or two or more recitations. Furthermore, in those instances where a convention analogous to "at least one of A, B, and C, etc." is used, in general such a construction is intended in the sense one having skill in the art would understand the convention, e.g., "a system having at least one of A, B, and C" would include but not be limited to systems that have A alone, B alone, C alone, A and B together, A and C together, B and C together, and/or A, B, and C together, etc. In those instances where a convention analogous to "at least one of A, B, or C, etc." is used, in general such a construction is intended in the sense one having skill in the art would understand the convention, e.g., "a system having at least one of A, B, or C" would include but not be limited to systems that have A alone, B alone, C alone, A and B together, A and C together, B and C together, and/or A, B, and C together, etc. It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

From the foregoing, it will be appreciated that various implementations of the present disclosure have been described herein for purposes of illustration, and that various modifications may be made without departing from the scope and spirit of the present disclosure. Accordingly, the various implementations disclosed herein are not intended to be limiting, with the true scope and spirit being indicated by the following claims.

What is claimed is:

1. A device implementable on a firearm, comprising:

a holster comprising a case with a void therein, the void configured to accommodate the firearm such that the firearm is at least partially received in the void responsive to the firearm being holstered in the void, wherein the case further comprises at least one physical feature configured to engage with at least one portion of the firearm as the firearm is inserted into the void to be holstered such that the firearm is rendered inoperable while being holstered, wherein, in engaging with the at least one portion of the firearm as the firearm is inserted into the void to be holstered, the at least one physical feature is configured to push or pull the at least one portion of the firearm as the firearm is inserted into the void to be holstered such that at least a slide or a barrel of the firearm is pushed or pulled rearward with respect to the firearm to render the firearm inoperable by disengaging the firearm, wherein the at least one physical feature comprises a tab extending from a portion of the case, and wherein the tab is configured to engage with a rear sight on the slide of the firearm such that, as the firearm is inserted into the void to be holstered, the tab pushes or pulls back the rear sight to move the slide rearward with respect to the firearm to disengage the firearm.

2. The device of claim 1, wherein the at least one physical feature is further configured to disengage from the at least one portion of the firearm as the firearm is withdrawn from the void to be unholstered such that the firearm is rendered operable upon being unholstered.

3. A device implementable on a firearm, comprising:

a holster comprising a case with a void therein, the void configured to accommodate the firearm such that the firearm is at least partially received in the void responsive to the firearm being holstered in the void, wherein the case further comprises at least one physical feature configured to engage with at least one portion of the firearm as the firearm is inserted into the void to be holstered such that the firearm is rendered inoperable while being holstered, wherein, in engaging with the at least one portion of the firearm as the firearm is inserted into the void to be holstered, the at least one physical feature is configured to push or pull the at least one portion of the firearm as the firearm is inserted into the void to be holstered such that at least a slide or a barrel of the firearm is pushed or pulled rearward with respect to the firearm to render the firearm inoperable by disengaging the firearm, wherein the at least one physical feature comprises a tab extending from a portion of the case, and wherein the tab is configured to engage with one or more serrations on the slide of the firearm such that, as the firearm is inserted into the void to be holstered, the tab pulls back the one or more serrations to move the slide rearward with respect to the firearm to disengage the firearm.

4. A device implementable on a firearm, comprising:

a holster comprising a case with a void therein, the void configured to accommodate the firearm such that the firearm is at least partially received in the void responsive to the firearm being holstered in the void, wherein the case further comprises at least one physical feature configured to engage with at least one portion of the firearm as the firearm is inserted into the void to be holstered such that the firearm is rendered inoperable while being holstered, wherein, in engaging with the at least one portion of the firearm as the firearm is inserted into the void to be holstered, the at least one physical feature is configured to push or pull the at least one portion of the firearm as the firearm is inserted into the void to be holstered such that at least a slide or a barrel of the firearm is pushed or pulled rearward with respect to the firearm to render the firearm inoperable by disengaging the firearm, wherein the at least one physical feature comprises a tab extending from a portion of the case, and wherein the tab is configured to engage with the barrel of the firearm such that, as the firearm is inserted into the void to be holstered, the tab pushes back the barrel to move the barrel and the slide rearward with respect to the firearm to disengage the firearm.

* * * * *